US005251936A

United States Patent [19]

Fitzgibbons

[11] Patent Number: 5,251,936

[45] Date of Patent: Oct. 12, 1993

[54] OVERLAP CHECK CONSTRUCTION OR SIMILAR BUSINESS FORM

[76] Inventor: Gary W. Fitzgibbons, UARCO Incorporated, W. County Line Rd., Barrington, Ill. 60010

[21] Appl. No.: 710,682

[22] Filed: Jun. 5, 1991

[51] Int. Cl.[5] ..... B42D 15/00

[52] U.S. Cl. ..... 283/58; 281/38; 283/101; 283/105; 283/903

[58] Field of Search ..... 281/38; 283/57, 58, 283/100, 101, 102, 105, 903

[56] References Cited

U.S. PATENT DOCUMENTS

| | | | |
|---|---|---|---|
| 244,049 | 7/1881 | Greensted | 281/38 |
| 371,440 | 10/1887 | Evans | 281/38 |
| 470,769 | 3/1892 | Thomson | 281/38 |
| 526,787 | 10/1894 | Middlekauff et al. | 281/38 |
| 646,363 | 3/1900 | Dodsworth | 281/38 |
| 756,611 | 4/1904 | Field | 281/38 |
| 916,034 | 3/1909 | Scholes | 281/38 |
| 1,003,326 | 9/1911 | Broudy . | |
| 1,248,488 | 12/1917 | Harriss | 281/38 X |
| 1,825,845 | 10/1931 | Ainsworth | 281/38 X |
| 3,856,332 | 12/1974 | Snedeker . | |
| 3,861,718 | 1/1975 | Strus . | |
| 4,346,917 | 8/1982 | Clancy . | |
| 4,643,455 | 2/1987 | North et al. . | |
| 4,697,970 | 10/1987 | Hanson . | |
| 4,714,276 | 12/1987 | Greig . | |
| 4,789,187 | 12/1988 | Corlew et al. . | |
| 4,842,919 | 6/1989 | David et al. . | |
| 4,882,211 | 11/1989 | McIntyre et al. . | |
| 4,938,414 | 7/1990 | Lippert . | |
| 5,026,196 | 6/1991 | Brass | 281/38 |

FOREIGN PATENT DOCUMENTS

| | | | |
|---|---|---|---|
| 665594 | 5/1988 | Austria | 283/105 |
| 281344 | 7/1988 | European Pat. Off. | 283/101 |
| 2227714 | 8/1990 | United Kingdom | 281/38 |

*Primary Examiner*—Paul A. Bell

[57] ABSTRACT

A two-part sheet construction (10) that may be separated into its individual parts without tearing is provided. First (12) and second (22) sheet segments, each segment having front (14, 24) and back (16, 26) sides and first (18, 24) and second (20, 30) opposed edges overlap each other at the second edge (20) of the first sheet segment (12) and the first edge (28) of the second sheet segment (22). The segments (12, 22) are joined together by a coating of a repeatedly releasable self-stick adhesive (32) applied to the first sheet segment (12) where the first sheet segment (12) is overlapped by the second sheet segment (22). Substantially the entirety of each of the front sides (14, 24) of both sheet segments (12, 22) are exposed when the segments are joined. A plurality of the two-part sheet constructions (10) may be stacked and formed into a pad of overlapping sheets (36) by joining the first edges (18) of the first sheet segments (12) together.

24 Claims, 2 Drawing Sheets

OVERLAP CHECK CONSTRUCTION OR SIMILAR BUSINESS FORM

BACKGROUND OF INVENTION

1. Technical Field

The present invention is directed towards a detachable sheet segment construction and more particularly to an overlap paper sheet segment construction such as for a check and check stub construction.

2. Background Art

Prior art paper product sheet segment constructions have been formed with a permanent adhesive applied to a portion of one sheet for permanently adhering that sheet to another sheet. Such permanent adhesives are well known for their substantial strength and frequently the paper must be torn before the adhesively-secured paper portions may be separated. Such permanent adhesives are also known to leave a residue on both of the joined sheets.

Many similar paper products have been formed with perforations effectively dividing a single sheet into two sheet segments which may be separated by tearing the sheet along the perforations. One application of such a paper product is a conventional checkbook wherein a plurality of perforated sheets are stacked and bound together by the first sheet segment and the second sheet segments are shingled therefrom. The second sheet segments are printed checks which can be removed from the first sheet segment or check stub by tearing along the perforations.

Some paper products have attempted to combine the aforementioned perforated structure with the aforementioned permanent adhesive. For example, U.S. Pat. No. 3,856,332 to Snedeker discloses a check and stub construction with the check and stubs separated by perforations and assembled into a checkbook Permanent adhesive surfaces protected by removable coverings are disposed along certain edges of checks and checkbook stubs to facilitate permanently reattaching the checks to each other and their corresponding stubs after use.

The structure disclosed in Snedeker has several problems. First, it is well known that once checks are removed from a checkbook they must be processed and handled through automated check reading/sorting machines at financial institutions. Should the removable covering protecting the adhesive surface become detached during this processing the adhesive may adhere to either the processing machinery or other checks and thus interfere with the automated check reading/sorting systems. Second, because of the difficulty of tearing the checks along the perforations it is common for the check or stub to be accidentally torn or for portions of the stub to remain on the check. Tearing of the check, or stub in pieces not removed from the check, can interfere with automated check reading/sorting machines. Third, the permanent nature of the adhesive of Snedeker means that once a check is returned to the checkbook and adhered thereto, it cannot be removed from the checkbook without tearing either the check or the stub. Fourth, applying the permanent adhesive and the removable covering to the checks and the stubs of Snedeker is time consuming and costly. Finally, when using the Snedeker structure both stubs and the checks must be made of heavy paper stock conforming to American Banking Association's standards, notwithstanding the fact that the stub does not need to be made of such a heavy weight and expensive paper.

In more recent years, repeatedly releasable self-stick adhesives have been developed In one application, a repeatedly releasable self-stick adhesive is applied to individual sheets at one end thereof, with the sheets or notes provided in pad form of overlapping shingled sheets and held together solely by repeatedly releasable self-stick adhesive strip. The individual sheets may be removed from the underlying sheet and the removed sheet repositioned with the repeatedly releasable self-stick adhesive adhered to another surface. Removal of the original sheets results in no tearing of either the sheet removed or the underlying sheet and none of the repeatedly releasable self-stick adhesive adheres to the surface upon which the sheet containing the adhesive is attached. Such structures are unsuitable for business form applications such checkbooks, however, because each sheet has the repeatedly releasable self-stick adhesive thereon and the adhesive would interfere with automated check reading/sorting equipment.

One modification of the above-described padded structure using a repeatedly releasable self-stick adhesive includes perforations dividing the portion of the sheet having the repeatedly releasable self-stick adhesive strip from the remainder of the sheet. Using this structure the adhesive portion of the sheet can be removed along the perforations to prevent its fouling sorting equipment. However, this structure requires that the entire sheet, including the stub, be constructed of the same type of paper. In addition, tearing along the perforated portion often results in tearing the stub or remaining portion of the sheet.

The present invention is directed toward overcoming one or more of the problems discussed above.

SUMMARY OF THE INVENTION

A two-part sheet construction that may be separated into its individual parts without tearing is provided. First and second sheet segments, each segment having front and back sides and first and second opposed edges overlap each other at the second end of the first sheet segment and the first end of the second sheet segment such that substantially the entirety of each of the front sides are exposed. A coating of a repeatedly releasable self-stick adhesive applied to the first sheet segment where it is overlapped by the second sheet segment joins the segments together.

The present invention further contemplates a pad of multiple part sheets that may be separated into individual parts without tearing. A plurality of sheets, each sheet having a pair of first and second sheet segments is provided. Each sheet segment has a front and a back and first and second opposed edges. The first edge of the segment second sheet overlaps the second edge of the first sheet segment such that substantially the entire front side of each sheet segment is uncovered by the other sheet segment. A coating of a repeatedly releasable self-stick adhesive applied to the first sheet segment where it is overlapped by the second sheet segment joins the segments together. The first edges of the first sheet segments of each sheet are bound together to form a pad of overlapping sheets.

Perforations may be provided intermediate the first and second edge of the first segment for permitting the first segment to be permanently removed from the pad of sheets. In addition, the first sheet segment may be of a weight less than the weight of the second sheet segment. Moreover, the repeatedly releasable self-stick adhesive is not transferable to the second sheet segment from the first sheet upon disengaging the first and second sheet segments.

The present invention further contemplates a pad of checks including a register of the type where the check register is a stub releasably secured to the check for recording a negotiation of the check and the stubs are joined at one edge to form a pad. A plurality of paper stubs and a plurality of paper checks are provided, each stub and check being associated with one of the other. The check is of a paper weight greater than the paper weight of the stub and sufficient to comply with banking requirements. Each stub and check has a front and a back and first and second opposed edges. The second edge of the stub overlaps the first edge of the check. The stub has a coating of a repeatedly releasable self-stick adhesive where the check and the stub overlap which releasably joins the check and the stub together. Substantially the entire front of the check and stub are exposed, that is, uncovered by the other. The first edges of the stub are bound together such that the plurality of the associated check and stubs are formed into a pad of overlapping checks and stubs. The repeatedly releasable self-stick adhesive is of a type such that the check and the stub may be separated without tearing or damage to either the check or the stub.

Perforations may be provided intermediate the first and second edges of the stub for separating the stub from the pad. The repeatedly releasable self-stick adhesive is not transferred to the check from the stub upon disengaging the check from the stub. The check and the stub each have a top and a bottom edge and each check and each stub may be attached at its top or bottom to the bottom or top, respectively, of an adjacent check or stub, respectively, the point of attachment being perforated.

The present invention has numerous advantages over prior art structures. Because substantially the entire front of the first and second segments are exposed, both segments of the two-part sheet construction may be simultaneously printed without the need for costly and time consuming collating of separate sheet segments and then bonding of the separate sheet segments. In addition, because the first and second sheets segments are adhesively bonded, the segments may be of different types or colors. For example, the segments may be of different paper weights where such a weight differential is advantageous. In one application, where the second sheet segment which is removed from the first sheet segment must be of a heavy paper stock, as for example, when the second sheet segment is a check which must conform to American Banking Association's standards, and the first sheet segment is a stub which must be of no particular weight, the first segment may be of a weight considerably less than that of the second segment, therefore effecting a savings in paper costs. Similar savings may be realized where the first sheet segment is a promotional correspondence and the second sheet segment is a postcard that is required to be of heavy stock for passing in the mail system. Moreover, because the repeatedly releasable self-stick adhesive is not transferred to the second sheet segment from the first sheet segment upon disengaging the first and second sheet segments, the second sheet segment may be processed or handled without fear of residual adhesive fouling handling or processing machinery. The repeatedly releasable self-stick nature of the adhesive bonding the sheet segments also permits the second sheet segment to be removed from the first sheet segment without tearing either the first or second sheet segments. Thus, once the second sheet segment is removed from the first sheet segment, the second sheet segment is of a uniform construction without adhesive residue or torn pieces attached thereto which could interfere with handling of the second sheet segment, as for example by automated check reading-/sorting machines. By providing perforations for separating the first segment from the pad of overlapping sheets, the first sheet segment may be removed from a pad and attached by means of the self-stick adhesive to records such as invoices or expense accounts, thus facilitating quick, easy and accurate record keeping. Or, in the alternative, first sheet segment may be maintained in the pad and, following processing and return of the second sheet segment, the second sheet segment may be repeatedly releasably adhered to the stub by means of the repeatedly releasable self-stick adhesive providing a convenient method for filing and keeping an accurate record of the contents of the second sheet segment. Finally, a checkbook manufactured according to the present invention is less expensive than prior art devices intended to provide such record keeping advantages and the checks removed therefrom are more fully compatible with existing financial institution check processing procedures and machinery.

Other objects, advantages and features of the present invention will become more apparent from a consideration of the following specification taken in conjunction with the accompanying drawings.

DETAILED DESCRIPTION OF THE PREFERRED EMBODIMENT

Figure 1:
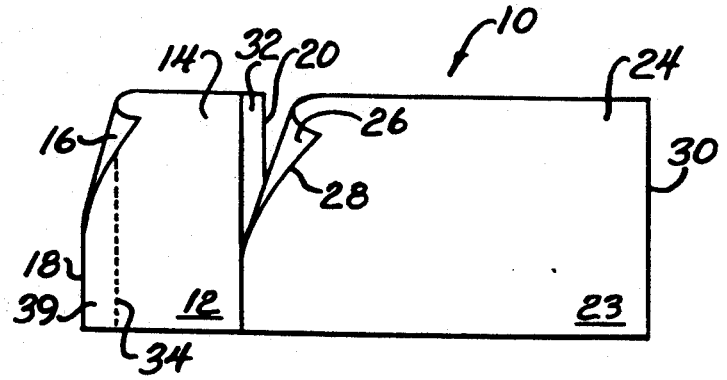
FIG. 1 is a front view of the present invention showing a second sheet segment being detached from or reattached to a first sheet segment.

The two-part sheet construction 10 of the present invention is illustrated in FIG. 1. A first sheet segment 12 has a front side 14, a back side 16 and first and second opposed edges 18, 20. A second sheet segment 22 has a front side 24 and a back side 26 and first and second opposed edges 28, 30.

On the front side 14 of the first sheet segment 12 adjacent the second edge 20 is a coating 32 of a repeatedly releasably self-stick adhesive. As illustrated in FIG. 1, the second sheet segment 22 is joined to the first sheet segment 12 by a portion of the back 26 of the second sheet segment 22 that overlaps the front 14 of the first sheet segment 12 along the first edge 20 of the first sheet segment 12 by a coating 32 of repeatedly releasable self-stick adhesive The preferred embodiment contemplates the first and second sheet segments 12, 22 being made of paper, although many other flexible materials known to the art may be suitable as well.

The first segment 12 and the second segment 22 may be of the same weight or of a different weight. For example, if the second sheet segment 22 is to be a check, American Banking Association's standards require that checks be printed on 24 pound paper (i.e., paper which weighs 24 pounds per ream, a ream size being 20×26 inches). Because the first sheet segment 12 is not required to be handled by financial institutions, it may be of a considerably lesser weight and therefore lower cost paper such as 18 pound bond. By using a lower weight and therefore lower cost paper for the first segment, considerable cost savings may be generated over systems wherein the first segment 12 and the second segment 22 are made of the same paper.

The coating 32 of repeatedly releasably self-stick adhesive may be made of any adhesive having the property of permanently adhering the surface upon which it is applied yet not transferring to any other surfaces with which it comes in contact. Moreover, the repeatedly releasable self-stick adhesive must have sufficient adhesive strength to hold two sheets together while at the same time not damaging or tearing either sheet upon separating the sheets Several adhesives are known in the art as having these properties including "3M1000" manufactured by Minnesota Mining and Manufacturing Company and "Liquid Magnet" manufactured by PDI, Inc.

The first segment 12 may have a detachable securing structure 34 intermediate its first edge 18 and second edge 20. The detachable securing structure 34 may consist of a line of perforations.

Figure 2:
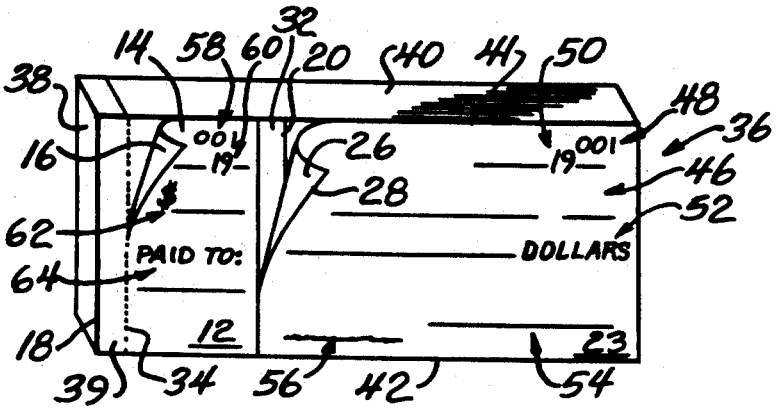
FIG. 2 a perspective view of a checkbook according to the present invention showing a check being detached from or reattached to the checkbook and a stub being detached from the checkbook.

FIG. 2 illustrates another embodiment of the present invention. The two-part sheet construction described above is stacked and formed into a pad of sheets 36 that may be separated into individual parts without tearing. A binding 38 is provided for binding the stubs 39 between the first edges 18 of the first sheet segments 12 and the line of perforation 34 into a pad of sheets 36, such as a checkbook. The binding 38 for binding the first edges 18 together may be any binding known in the art including staples or glues.

FIGS. 2-5 represent alternative embodiments of the present invention. For convenience, like elements in FIGS. 2-5 will be indicated with identical reference numbers having no prime, one prime, two primes and three primes, respectively. Discussion of such elements generally will be conducted without indicating primes corresponding to FIGS. 3-5.

Figure 3:
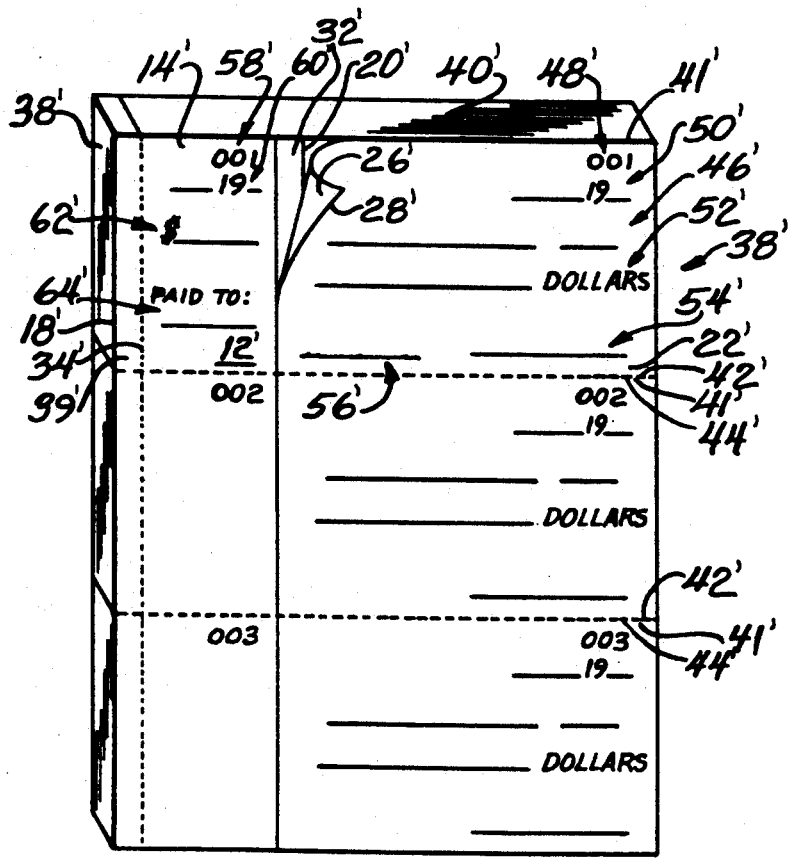
FIG. 3 is a perspective view of another configuration of a checkbook according to the present invention showing a check being detached or reattached.

FIG. 3 illustrates a third embodiment of the present invention. A stacked pad of sheets 40 is formed from first sheet segments 12' and second sheet segments 22' jointed at their tops 41' or bottoms 42' to the bottoms 42' or tops 41' of adjacent first sheet segments 12' and second sheet segments 22' respectively. The bottoms 42' and tops 41' of each first and second sheet segment 12', 22' are separated by a detachable securing structure 44' such as horizontal lines of perforations.

Figure 4:
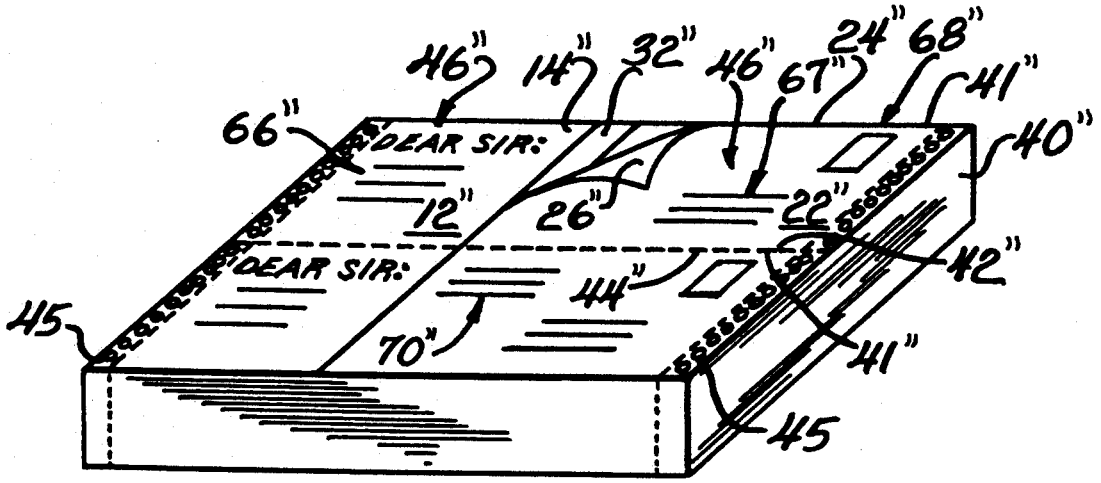
FIG. 4 is a perspective view of a direct mail response form for printing on a continuous feed impact or non-impact printer bearing printed indicia.

FIG. 4 illustrates a fourth embodiment of the present invention. A stacked pad of sheets 40" is formed from first sheet segments 12" and second sheet segments 22" joined to the top 41" and the bottom 42" of adjacent first sheet segments 12" and second sheet segments 22", respectively. The bottom 42" and tops 41" of each first and second sheet segment 12", 22", are separated by a detachable securing structure 44" such as horizontal lines of perforation.

This embodiment contemplates a form used for soliciting direct mail responses. The first sheet segments 12" is a correspondence soliciting return of the second sheet segment 22" which is a postcard. The first sheet segment 12" may be of a weight significantly less than the second sheet segment 22" which must have a weight sufficient to permit it to pass in the postal system. Thus, for example, the first sheet segment 12" may be a 20 pound (3.5 mils. thick) bond paper and the second sheet segment 22" could be a 38 pound (7 mils. thick) bond paper. Because the adhesive layer 32" remains on the first paper segment 12", the second sheet segment 22" may pass through the postal system without adversely affecting automatic postal sorting machines. As illustrated in FIG. 4, this product could include detachable punch holes 45 so that the forms could be fed in a continuous feed impact or non-impact printer.

Figure 5:
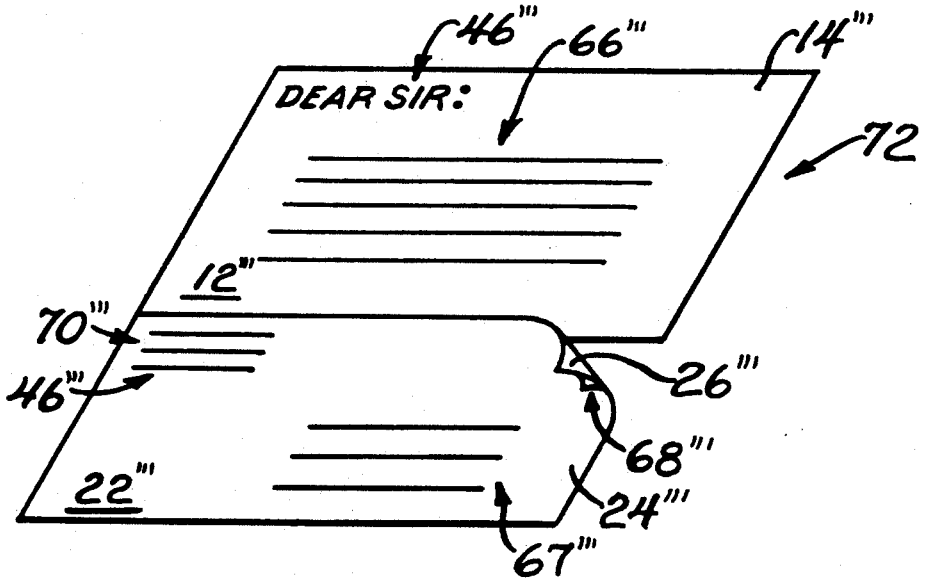
FIG. 5 is a perspective view of a direct mail response form for printing on a cut sheet printer bearing printed indicia.

As illustrated in FIGS. 2-5, indicia 46 may be provided on the fronts 14, 24 of the first or second sheet segments 12,22. FIGS. 2 and 3 illustrate this indicia may be used to make the second sheet segment 22,22' into a check and the first sheet segment 12,12' into a recording stub. FIGS. 4 and 5 illustrate this indicia can be used to make the second sheet segment 22",22"' into a postcard and the first sheet segment 12", 12"' into a mail response solicitation. In the case of checks, the indicia 46,46' will include a check number 48,48' space to fill in the date of the check 50,50' space to fill in the amount of the check 52,52', a signature block 54,54' and the preprinted machine-readable bank identification and account number 56,56'. The corresponding stub will include the check number 58,58' and space to record the date 60,60', amount [61] 62,62' and payee 64 of each check. Although not illustrated, it is readily apparent that indicia may also be included on the backs 16,26 of the first and second sheet segments 12,22. Those skilled in the art will recognize that first and second sheet segments 12,22 joined as contemplated by the present invention may be simultaneously printed after joining, obviating the need for post printing collating and assembly.

In the case of business forms used for soliciting direct mail responses, the indicia 46",46"' on the first sheet segment 12",12"' will include a message 66",66"' to the customer and the second sheet segment or return postcard 22",22"' will include a space [66] 67",67"' for the solicitor's address and a pre-printed stamp 68", 68"' or place for the customer's stamp, and an area 70",70"' for a return address.

Referring to the embodiments in FIGS. 4 and 5, those skilled in the art will recognize that by including the punch holes 45 at the margins of the first and second segments 12", 22", the stack of forms 40" may be continuously fed in a continuous feed impact or non-impact printer. The cut sheet form 72 illustrated in FIG. 5 may be fed on cut sheet non-impact printers and copiers.

Using the present invention, the second sheet segment 22 may be removed from the first sheet segment 12 by peeling the first edge 28 off the coating 32 of repeatedly releasable self-stick adhesive 32. In so removing the first segment 22, neither the second sheet segment 22 nor the first sheet segment 12 will be torn or otherwise damaged. When, for example, the second sheet 22 is a check which has been removed for negotiation and the first sheet segment 12 is a stub for recording information about the check, the check may reattached to the stub by the coating 32 of repeatedly releasable self-stick adhesive following processing for the purpose of maintaining a record of canceled checks. Because the repeatedly releasable self-stick adhesive will not adhere as a residue to the back 26 of a second sheet segment 22, when the second sheet segment 22 is a check the check may be processed without concern of residual adhesive interfering with the check reading/sorting machines.

As an alternative to reattaching a second sheet segment 22 to the first segment 12, the first sheet segment 12 may be attached by the repeatedly releasable self-stick coating to an invoice or any other document where it would be beneficial to have record of notations made on the first sheet segment 12.

As best illustrated in FIG. 2, when the first and second sheet segments 12, 22 are attached in a stacked pad of sheets 36, a first sheet segment 12 can be removed from the pad of sheets or stacked pad of sheets 36 by tearing along the perforations 34 for recording keeping purposes as discussed above.

As illustrated in FIG. 3, first sheet segments 22 may be removed from the stacked pad of sheets 38 by peeling the first edge 28 of the second sheet 22 from the coating 32 of repeatedly releasable self-stick adhesive and then tearing the top or bottom from an adjacent sheet segment 22 along the perforation 44.

The two-part continuous or cut sheet construction of the present invention provides a construction suitable for concurrent computer printing of first and second sheet segments. Thus, expensive and time consuming separate computer printing, collating and matching is eliminated This feature is of particular advantage where, for example, the first sheet segment is a check stub intended to bear a number and identifying information identical to a check formed from the second sheet segment, or where the form is a direct mail response form and the solicitation bears the customers name and so does the return postcard In addition, the first and second sheet segments may be separated without cutting or tearing. Moreover, repeatedly releasable self-stick adhesive used to adhere the first and second sheet segments permits the second sheet segment to be removed and processed without fear of residual adhesive or torn segments interfering the handling or processing of the second sheet segment.

A checkbook construction in accordance with FIGS. 2 and 3 provides numerous advantages over prior art devices. First, as discussed above, use of the repeatedly releasable self-stick adhesive means that no foreign material will be left on a check removed from a checkbook according to the present invention. Thus, such a check may be readily processed through check reading/sorting machines at financial institutions without risk of interfering with the operation of such machines In addition, the present invention permits the stub portion to be of a different color, texture or of a paper weight less than that of the check, providing a significant opportunity for paper cost savings Finally, the stub portions of the present invention may be attached by the repeatedly releasable self-stick adhesive to report or records without the need of staples or additional adhesives, thus streamlining the recording keeping process. These advantages are also shared by direct mail response form of the present invention.

We claim:

1. A two-part sheet construction that may be separated into its individual parts without tearing comprising:

first and second sheet segments, each segment having a front and a back side and first and second opposed edges, the edges of both sheet segments being of substantially identical lengths;

the first edge of the second sheet segment overlapping substantially the entirety of the second edge of the first sheet segment such that substantially the entirety of each of the front sides are exposed; and a repeatedly releasable self-stick adhesive coating being on the first sheet segment where the second sheet segment overlaps the first sheet segment.

2. The two-part sheet construction of claim 1 wherein the first and second segments are made of different weight papers.

3. The two-part sheet construction of claim 1 further comprising means for detachably securing on the first segment together intermediates the first and second edges defining a stub on the first segment.

4. The two-part construction of claim 3 wherein the detachable securing means comprises perforations.

5. The two-part sheet construction of claim 1 wherein the repeatedly releasable self-stick adhesive is characterized in that it is substantially non-transferable to the second sheet segment from the first sheet segment upon disengaging the first and second segments.

6. A pad of two-part sheets comprising a plurality of two-part sheet constructions of claim 1, each sheet segment having third and fourth opposed edges, the two-part sheet constructions being attached together by said third and fourth edges.

7. A pad of sheets that may be separated into individual parts without tearing comprising:

a plurality of sheets;

each sheet having a first and second sheet segment, each sheet segment having a front and a back and first and second opposed edges;

the first edge of the second sheet segment overlapping second edge of the first sheet segment such that substantially the entirety of each of the front sides of the first and second sheet segments are uncovered by the other sheet segment;

a repeatedly releasable self-stick adhesive coating on the first sheet segment where the second sheet segment overlaps the first sheet segment, the sheets being stacked one upon another with the first edges of the first sheet segments aligned; and means for binding the first edge of the first segment of each sheet to the first edge of the first segment of each other sheet.

8. The pad of sheets of claim 7 wherein the first segment has detachable securing means intermediate its first and second edge.

9. The pad of sheets of claim 8 wherein the detachable securing means comprises perforations.

10. The pad of sheets of claim 7 wherein the first segment is of a paper weight X and the second segment is of paper weight Y, Y being unequal to X.

11. The pad of sheets of claim 10 wherein Y is greater than X.

12. The pad of sheets of claim 7 wherein the repeatedly releasable self-stick adhesive is characterized in that it is substantially nontransferable to the second sheet segment from the first sheet segment upon disengaging the first and second segments.

13. The pad of sheets of claim 7 wherein indicia is provided on the front or back side of the first or second sheet segments.

14. A pad of checks including a check register of the type wherein the check register is a stub releasably secured to the check for recording the negotiation of the check and the stubs are joined at one edge to form a pad, the pad of checks including a check register comprising:

a plurality paper stubs and a plurality of paper checks, each stub and check being associated with one of the other;

each stub being of a paper weight X and each check being of a paper weight Y, with Y being greater than X;

each associated stub and check having a front and a back and first and second opposed edges;

the second edge of the stub being overlapped by the first edge of the check;

the stub having a coating of a repeatedly releasable self-stick adhesive where the check overlaps the stub joining the check and the stub together;

substantially the entire face of the check and the stub being uncovered by the other; and means for binding the first ends of each stub such that the plurality of associated checks and stubs is formed into pad of overlapping checks and stubs.

15. The pad of checks of claim 14 wherein:

indicia is provided on the front of the first and second sheet segments.

16. The pad of checks of claim 14 further comprising means for separating the check from the stub without tearing or damage to the check or the stub.

17. The pad of checks of claim 14 wherein:

the stub is perforated intermediate its first and second edge for separating the stub from pad of overlapping checks and stubs.

18. The pad of checks of claim 14 wherein:

the repeatedly releasable self-stick adhesive is characterized by the inability to be transferred to the check from the stub upon disengaging the check from the stub.

19. A pad of checks comprising:

the checks and the stubs of claim 14, each having a top and bottom edge, each of the checks and stubs being attached at the top or bottom edge to the bottom or top edge, respectively, of a like check or stub, respectively, the point of attachment being perforated.

20. A direct mail response form comprising:

a solicitation portion and a mail response portion, each portion having a front and a back side and a first and second opposed edges, the first and second edges of both portions being substantially the same length;

the first edge of the mail response portion overlapping substantially the entirety of the second edge of the solicitation portion such that substantially the entirety of each of the front sides are exposed; and a repeatedly releasable self-stick adhesive coating being on the solicitation portion where the solicitation portion overlaps the mail response portion.

21. The direct mail respects form of claim 20 wherein the solicitation portion comprises a paper having a weight different from the weight of the paper of the mail response portion.

22. The direct mail response form of claim 20 further comprising corresponding indicia upon the solicitation portion and the mail response portion.

23. A pad of direct mail response forms comprising:

a plurality of direct mail response forms of claim 20, each having third and fourth opposing edges, said third and fourth opposing edges being attached together; and the second edge of the mail response portion and the first edge of the solicitation portion having a plurality of punch holes proximate thereto along the extent of the edges.

24. The direct mail response form of claim 23 further comprising a line of perforation between the third and fourth edges of attached forms.

* * * * *